US012196530B2

(12) United States Patent
Alsheuski

(10) Patent No.: US 12,196,530 B2
(45) Date of Patent: Jan. 14, 2025

(54) MOUNTING APPARATUS AND METHOD FOR SUPPORTING A NIGHT VISION DEVICE

(71) Applicant: JSC YUKON ADVANCED OPTICS WORLDWIDE, Vilnius (LT)

(72) Inventor: Aliaksandr Alsheuski, Vilnius (LT)

( * ) Notice: Subject to any disclaimer, the term of this patent is extended or adjusted under 35 U.S.C. 154(b) by 40 days.

(21) Appl. No.: 18/020,505

(22) PCT Filed: Aug. 11, 2021

(86) PCT No.: PCT/EP2021/072426

§ 371 (c)(1),
(2) Date: Feb. 9, 2023

(87) PCT Pub. No.: WO2022/034155

PCT Pub. Date: Feb. 17, 2022

(65) Prior Publication Data

US 2023/0266101 A1 Aug. 24, 2023

(30) Foreign Application Priority Data

Aug. 11, 2020 (GB) ..... 2012508

(51) Int. Cl.
*F41G 1/38* (2006.01)
*F41G 11/00* (2006.01)

(52) U.S. Cl.
CPC ..... *F41G 11/006* (2013.01); *F41G 1/38* (2013.01); *F41G 11/003* (2013.01)

(58) Field of Classification Search
CPC ..... F41G 11/006; F41G 1/38
See application file for complete search history.

(56) References Cited

U.S. PATENT DOCUMENTS 6,640,481 B1 11/2003 Williams
2016/0377385 A1 12/2016 Culp
(Continued)

FOREIGN PATENT DOCUMENTS

EP 2843354 A1 3/2015
WO 2019162926 A1 8/2019

OTHER PUBLICATIONS

International Search Report for corresponding application PCT/EP2021/072426 filed Aug. 11, 2021; Mail date Nov. 15, 2021.
(Continued)

*Primary Examiner* — J. Woodrow Eldred
(74) *Attorney, Agent, or Firm* — CANTOR COLBURN LLP

(57) ABSTRACT

Some embodiments of the present invention provide a mounting apparatus for supporting a device such as a night vision (30) device comprises a clamp (60) having an opening for receiving an end portion of the night vision device. The clamp has a concave inner surface (68) when viewed in cross-section and a longitudinal axis (54). An insert (70) is configured to locate within the opening of the clamp (60). The insert (70) has an inner surface (72) for locating against the night vision device (30), or the insert (70) being integrated with the night vision device (30), the insert (70) having a convex outer surface (78) when viewed in cross-section, wherein the convex outer surface (78) of the insert is movable across the concave inner surface (68) of the clamp to allow adjustment of a position of the insert (70) relative to the clamp (60) about an x axis and/or a y axis which are mutually perpendicular to the longitudinal axis (54). The clamp (60) is configured to secure the insert (70) in a selected position.

23 Claims, 10 Drawing Sheets

(56) References Cited

U.S. PATENT DOCUMENTS

2019/0368840 A1 12/2019 Banes
2021/0025676 A1* 1/2021 Reis Green ..... F41G 11/003

OTHER PUBLICATIONS

Written Opinion for corresponding application PCT/EP2021/072426 filed Aug. 11, 2021; Mail date Nov. 15, 2021.

* cited by examiner

MOUNTING APPARATUS AND METHOD FOR SUPPORTING A NIGHT VISION DEVICE

BACKGROUND

A rifle or other weapon is typically provided with a day sight. A day sight is an optical device which operates in the visible wavelength band. It allows a user to accurately view a target and align the rifle with the target. A day sight is typically used during day light conditions.

In conditions of low light or darkness it is necessary to use a night vision device (NVD), also called a night vision element or a night sight. A night vision device may use an image intensifier, a digital image sensor (such as an image sensor which operates in the near infra red (NIR) wavelength band) or some other technology to assist vision. A night vision device may be mounted on a rifle in front of the day sight. The night vision device provides an output image which is viewed by the day sight. This type of night vision device can be called a night vision front attachment (NVD FA). An advantage of providing the night vision device as a front attachment is that the user can continue to use their main day sight in all lighting conditions. During low light conditions, the NVD FA enhances the view through the day sight.

One known way of attaching the night vision device to the rifle is by attaching the night vision device to the front end of the day sight. The night vision device has a socket which fits around the front end of the day sight and a clamp to secure the night vision device. Another known way of attaching the night vision device to the rifle is by attaching the night vision device to a body of the rifle, in front of the day sight. This has an advantage that the night vision device is supported directly by the rifle.

The day sight is typically a telescopic device with a narrow field of view. When fitting a night vision device in front of a day sight, there can be an unwanted offset between an image output by the night vision device and an optical field of view of the day sight.

SUMMARY OF THE INVENTION

There is provided a mounting apparatus for supporting a night vision device, the mounting apparatus comprising:

a clamp having an opening for receiving an end portion of the night vision device, the clamp having a concave inner surface when viewed in cross-section and a longitudinal axis;

an insert configured to locate within the opening of the clamp, the insert having an inner surface for locating against the night vision device, or the insert being integrated with the night vision device, the insert having a convex outer surface when viewed in cross-section, wherein the convex outer surface of the insert is movable across the concave inner surface of the clamp to allow adjustment of a position of the insert relative to the clamp about an x axis and/or a y axis which are mutually perpendicular to the longitudinal axis; and wherein the clamp is configured to secure the insert in a selected position.

An advantage of at least one example or embodiment is allowing adjustment of a position of a night vision device relative to a day sight. This can allow an image output by the night vision device to be aligned centrally within a field of view of the day sight. This provides the user with a clear view of the entire image output by the night vision device.

The insert may be secured solely by inward radial pressure applied by an inner surface of the clamp around the insert, by a combination of inward radial pressure applied by the clamp around the insert and additional inward radial pressure provided by one or more fastenings which act on the outer surface of the insert, or by inward radial pressure provided by one or more fastenings which act on the outer surface of the insert.

Optionally, the clamp has a radial bore for receiving a fastening to secure the insert in a selected position. The fastening may act directly on the outer surface of the insert, or the insert may have a recess for receiving a distal end of the fastening.

Optionally, the recess is defined by radial walls of the insert, and wherein the recess has a dimension which is greater than a width of the distal end of the fastening to allow adjustment of adjustment of a position of the insert relative to the clamp. The radial walls acts as stops to limit movement of the insert relative to the clamp.

Optionally, the recess extends around the outer surface of the insert to permit rotational adjustment of a position of the insert relative to the clamp.

Optionally, there is a plurality of fastenings spaced around the clamp.

Optionally, there is a pair of fastenings at diametrically opposite positions on the clamp.

Optionally, the insert comprises a circular element with a continuous inner surface. Alternatively, the insert may comprise a plurality of arcuate segments which are spaced apart around a perimeter of the opening.

Optionally, the clamp is configured to apply a radially inwardly directed retaining force on the insert, wherein the retaining force is applied via the inner surface of the clamp.

Optionally, the clamp comprises a first C-shaped element and a second C-shaped element which together define the opening, and a fastening mechanism which is configured to tighten the first C-shaped element and the second C-shaped element together.

Optionally, each of the first C-shaped element and the second C-shaped element has a radially extending portion at each end, wherein the fastening mechanism is configured to apply a retaining force between a respective radially extending portion of the first C-shaped element and the second C-shaped element.

Optionally, each of the radially extending portions has a bore for receiving a fastening.

Optionally, the clamp is provided at a forward end of the mounting apparatus, the mounting apparatus having a rearward end and a through passage between the forward end and the rearward end, the through passage including the opening.

Optionally, the mounting apparatus is configured to one of: connect to a body of a rifle; connect to a day sight.

Optionally, the clamp is provided at a forward end of the mounting apparatus, the mounting apparatus having a fitting at a rearward end for fitting to a day sight.

Optionally, the fitting comprises a clamp which defines an opening for receiving an end portion of the day sight device.

Optionally, the mounting apparatus is configured to connect to a body of a rifle, the mounting apparatus comprising a fitting for fitting to a housing of the rifle. For example, the mounting apparatus may be configured to connect to a rail on an upper face of the body of a rifle.

Optionally, the insert is removable from the clamp.

There is also provided a combination of: a night vision device comprising an end portion; and the mounting apparatus. The insert may be provided on (e.g. integrated with) the end portion of the night vision device. Alternatively, the insert may be provided as a separate element to the clamp and the night vision device.

There is also provided a clamp for use in the mounting apparatus, the clamp having an opening for receiving an end portion of the night vision device, the clamp having a concave inner surface and a longitudinal axis, wherein the clamp is configured to receive an insert having a convex outer surface, wherein the convex outer surface of the insert is movable across the concave inner surface of the clamp to allow adjustment of a position of the insert relative to the clamp about an x axis and/or a y axis which are mutually perpendicular to the longitudinal axis, wherein the clamp is configured to secure the insert in a selected position.

In another aspect there is provided a method of supporting a night vision device, comprising:

receiving an end portion of the night vision device in an opening of a clamp having a concave inner surface when viewed in cross-section and a longitudinal axis;

providing an insert having an inner surface for locating against the night vision device, or the insert being integrated with the night vision device, whereby a convex outer surface of the insert when viewed in cross-section is movable across the concave inner surface of the clamp to allow adjustment of a position of the insert relative to the clamp about an x axis and/or a y axis which are mutually perpendicular to the longitudinal axis; and securing the insert in a selected position by means of the clamp.

In one aspect there is provided a method of supporting a night vision device, comprising providing a mounting apparatus according to a preceding aspect; and coupling an end portion of the night vision device to the mounting apparatus by means of the clamp.

In one aspect of the present invention there is provided a mounting apparatus for supporting a device, optionally an optical device, further optionally a night vision device, the mounting apparatus comprising:

clamping means having an opening for receiving an end portion of the device, the clamping means having a concave inner surface when viewed in cross-section and a longitudinal axis;

an insert configured to locate within the opening of the clamping means, the insert having an inner surface for locating against the device, or the insert being integrated with the device, the insert having a convex outer surface when viewed in cross-section, wherein the convex outer surface of the insert is movable across the concave inner surface of the clamping means to allow adjustment of a position of the insert relative to the clamping means about an x axis and/or a y axis which are mutually perpendicular to the longitudinal axis; and wherein the clamping means is configured to secure the insert in a selected position.

The clamping means may comprise a clamp.

In another aspect there is provided a method of supporting a device, optionally an optical device, further optionally a night vision device, comprising:

receiving an end portion of the device in an opening of clamping means having a concave inner surface when viewed in cross-section and a longitudinal axis;

providing an insert having an inner surface for locating against the device, or the insert being integrated with the device, whereby a convex outer surface of the insert when viewed in cross-section is movable across the concave inner surface of the clamping means to allow adjustment of a position of the insert relative to the clamping means about an x axis and/or a y axis which are mutually perpendicular to the longitudinal axis; and securing the insert in a selected position by means of the clamping means.

Embodiments of the invention may be understood with reference to the appended claims.

Within the scope of this application it is envisaged that the various aspects, embodiments, examples and alternatives, and in particular the individual features thereof, set out in the preceding paragraphs, in the claims and/or in the following description and drawings, may be taken independently or in any combination. For example, features described in connection with one embodiment are applicable to all embodiments, unless such features are incompatible.

For the avoidance of doubt, it is to be understood that features described with respect to one aspect of the invention may be included within any other aspect of the invention, alone or in appropriate combination with one or more other features.

BRIEF DESCRIPTION OF THE DRAWINGS

One or more embodiments of the invention will now be described, by way of example only, with reference to the accompanying figures in which.

DETAILED DESCRIPTION

Figure 1:
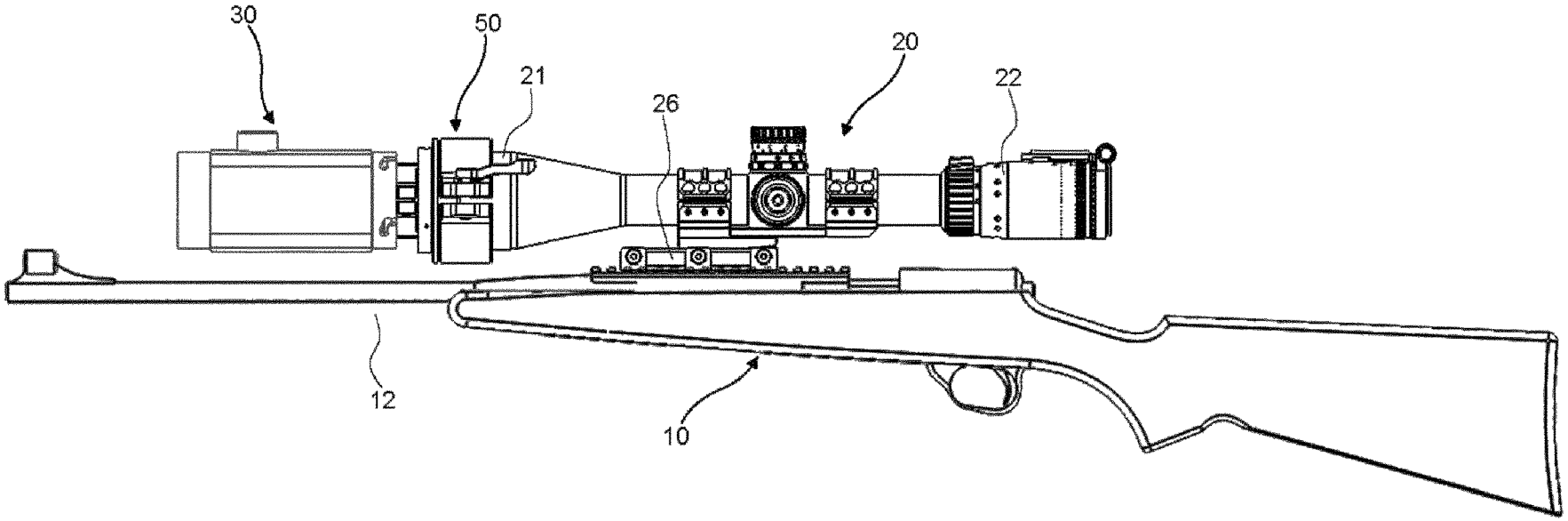
FIG. 1 shows an example of a rifle with a night vision device mounted to a front of a day sight via a mount.

FIG. 1 shows an example of a rifle 10 with a day sight 20 and a night vision device 30. Other names for these devices are rifle scopes or scopes. The day sight 20 is mounted to the rifle 10, such as to a mounting rail provided on a top surface of the rifle. The day sight 20 has a forward end 21 and a rearward end 22. An eye cup is provided at the rearward end 22 of the day sight to allow a user to aim the rifle. The night vision device 30 is fitted to a forward end 21 of the day sight 20 via a mounting apparatus or mount 50. The mount 50 connects to a rearward end of the night vision device 30 and to the forward end 21 of the day sight 20. This type of night vision device can be called a night vision front attachment (NVD FA). An advantage of providing the night vision device as a front attachment is that the user can continue to use their main day sight 20 in all lighting conditions. During low light conditions, the NVD FA enhances the view through the day sight.

The night vision device 30 can take various forms. In broad terms, the night vision device 30 provides an output image under low light conditions. Examples of night vision devices are described in EP 2 843 354 A1 and WO 2019/162926 A1. The night vision device may have a forward optical assembly (e.g. one or more lenses) at the forward end of the imaging device and a rearward optical assembly (e.g. one or more lenses) at the rearward end of the imaging device. The night vision device may comprise an image intensifier device positioned between the forward optical assembly and the rearward optical assembly. Alternatively, the night vision device may comprise an image sensor and a display positioned between the forward optical assembly and the rearward optical assembly. The image sensor may operate in the near infra red (IR) wavelength band. Incoming light is detected by the image sensor, image data is read from the image sensor and processed by a processor or electronics in the digital domain, and an image is output by the display. The displayed image is viewed via the day sight 20. Alternatively, the night vision device may use some other technology to assist vision. The night vision device may comprise a power source (e.g. a battery).

Figure 2:
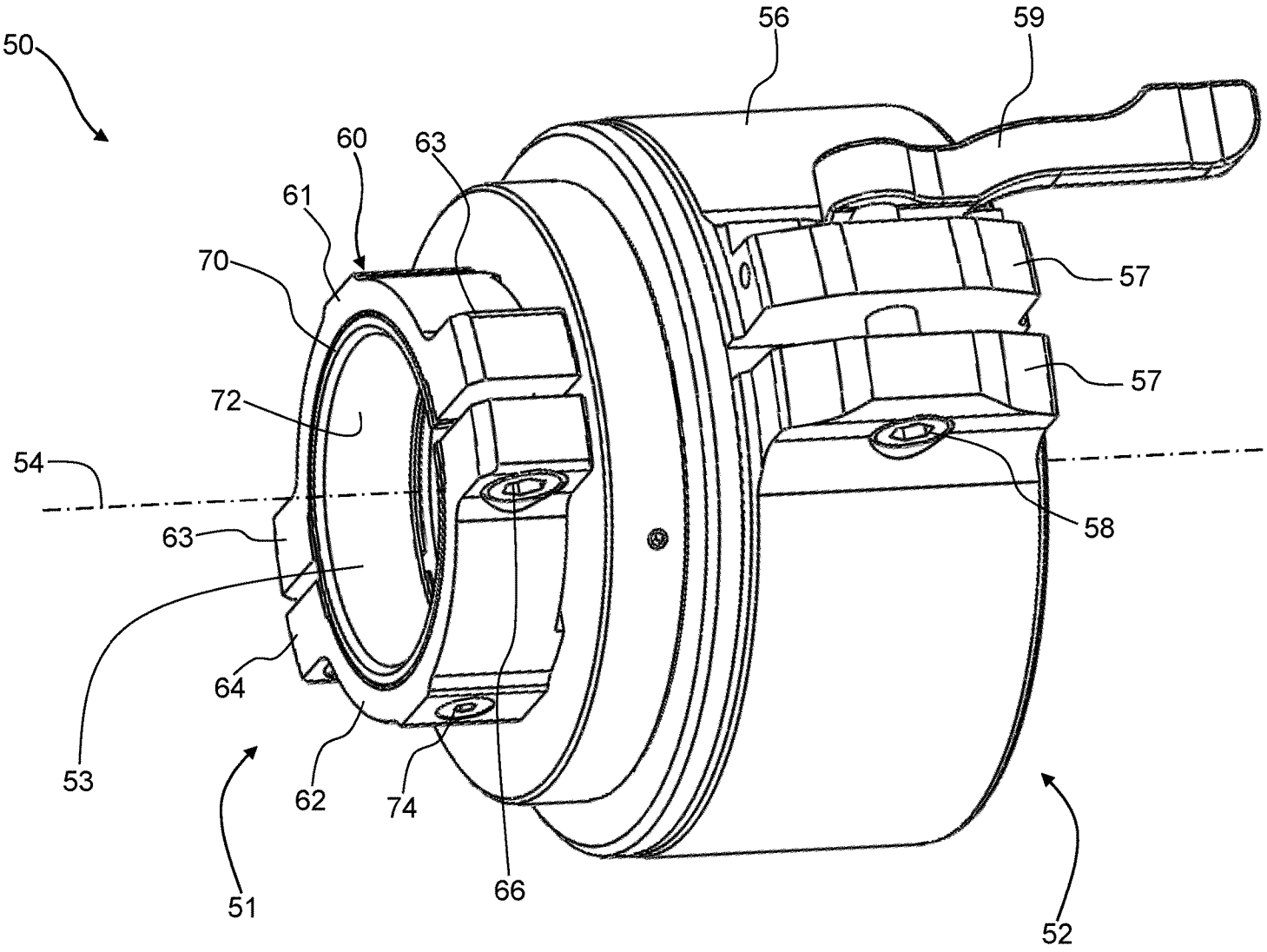
FIG. 2 shows mount of FIG. 1.
Figure 3:
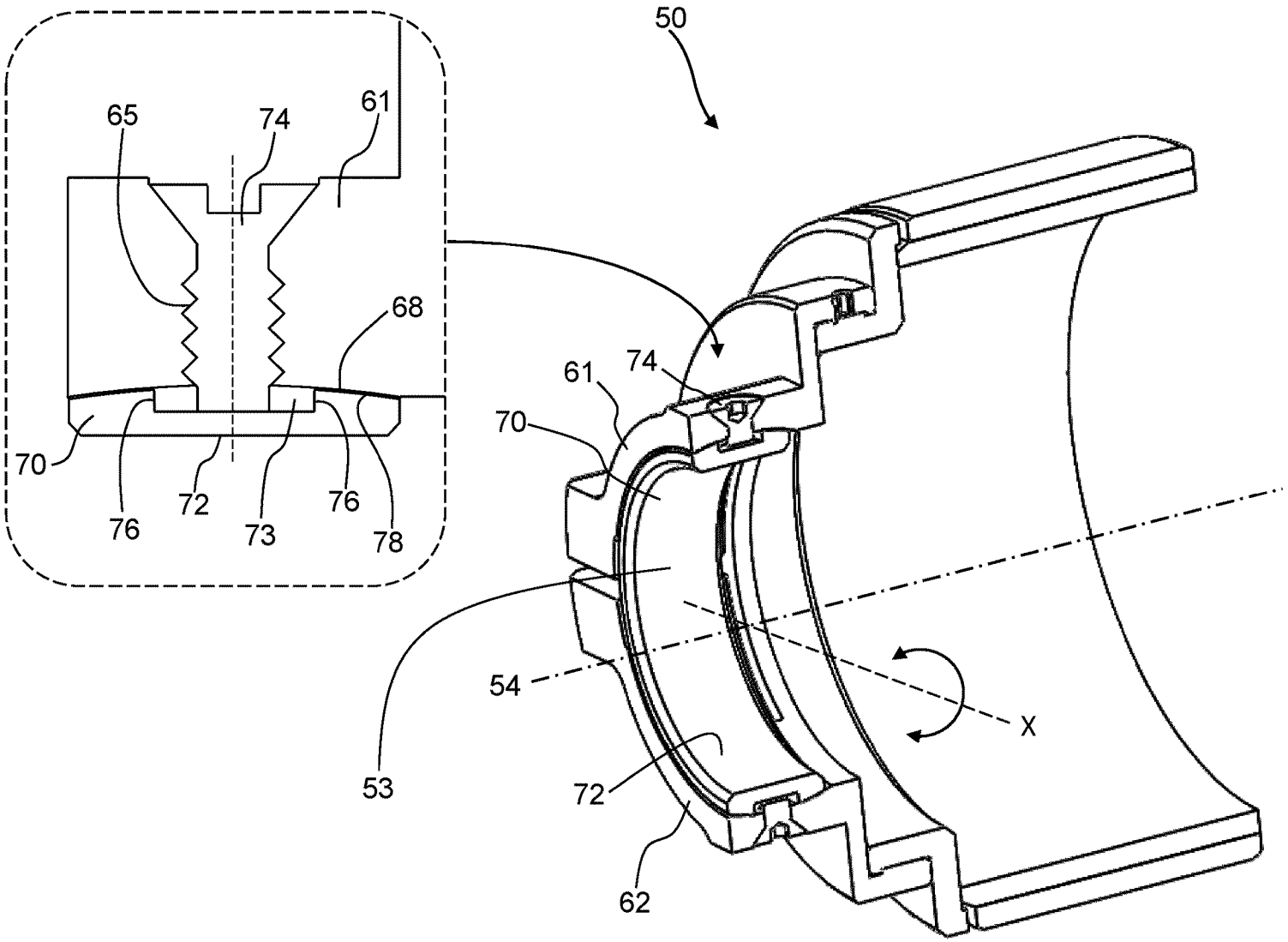
FIG. 3 shows a cut-away of the mount of FIG. 2.

FIGS. 2 and 3 show the mount 50 in more detail. FIG. 2 shows a perspective view of the mount 50. The night vision device 30 and the day sight 20 are not shown in these drawings. The mount 50 has a forward end 51 and a rearward end 52. The mount 50 has a through passage between the forward end 51 and the rearward end 52. This provides an unobstructed line of sight between an optical output of the night vision device 30 fitted to the forward end 51 and an optical input of the day sight 20 fitted to (or positioned downstream of) the rearward end 52 of the mount. The mount 50 comprises a first fitting 60 at a first (forward) end 51 of the mount for fitting to the night vision device 30. The mount 50 has a longitudinal axis 54 passing through the centre of the mount. The first fitting 60 comprises a clamp with a pair of generally C-shaped, or semi-circular shaped, elements 61, 62. The clamp 60 defines an opening 53 for receiving a rearward end (neck) of the night vision device 30. Each of the clamp elements 61, 62 has a pair of radially extending portions ("ears") 63, 64. There is a radially extending portion 63 at each end of the first C-shaped element 61. Similarly, there is a radially extending portion 64 at each end of the second C-shaped element 62. Each of the radially extending portions 63, 64 has a bore extending through it. Each of the bores is aligned perpendicularly to the radially extending portions. The bores in an adjacent pair of radially extending portions 63, 64 axially align with one another. One or both of the bores can be threaded. A fastening 66 is fitted to the bores in the adjacent pair of radially extending portions 63, 64. The fastening can be a bolt, a screw or any other suitable fastening. For example, a nut can be held captive in one of the radially extending portions 63, 64, and the nut can receive a threaded bolt passing through the radially extending portions 63, 64.

An insert 70 is configured to locate within the opening of the clamp. In this example the insert 70 is a tubular or ring-shaped element. The insert 70 has a cylindrical inner surface 72 for locating against the neck of the night vision device. When the insert 70 is centrally located, the inner surface 72 may be parallel to the longitudinal axis 54 of the mount 50. In use, the insert 70 is positioned between the clamp 60 and the neck of the night vision device 30. In use, the fastenings 66 can be tightened to cause the clamp elements 61, 62 to move towards one another, thereby tightening the clamp 60 and the insert 70 around the neck of the night vision device. In this example the insert 70 is a cylindrical-shaped element with a continuous inner surface 72. Other possible forms of the insert are described later.

In this example the mount 50 comprises a second fitting at the second (rearward) end 52 of the mount for fitting to the day sight device 20. In this example, the second fitting at the rearward end 52 of the mount comprises a clamp with a generally hoop-shaped element 56 which defines an opening for receiving a forward end of the day sight 20. The hoop-shaped element 56 has a pair of radially extending portions (ears) 57. There is a radially extending portion 57 at each end of the hoop-shaped element 59. The radially extending portions 57 each have a bore. The bores in adjacent ears 57 axially align with one another. A fastening 58 is fitted to the bores in the adjacent radially extending portions 57. The fastening is a bolt, a screw or any other suitable fastening. An adjustment lever 59 is provided to tighten or loosen the fastening 58. In use, the fastening 58 can be tightened to cause the ends (and ears) of the clamp 56 to move towards one another, thereby tightening the clamp and the day sight.

FIG. 3 shows a cut-away through the mount 50, and a more detailed view of part of the mount 50. The cut-away is taken along a plane which passes vertically through the longitudinal axis 54. As described above, the insert 70 is a tubular or ring-shaped element with an inner surface 72 for locating against the neck of the night vision device. The inner surface 72 is generally cylindrical. When the insert 70 is centrally located, as shown in FIG. 3, the inner surface 72 is coaxial about the longitudinal axis 54 of the clamp 60. When viewed in cross-section, an outer surface 78 of the insert 70 is generally convex in shape. That is, the outer surface 78 of the insert 70 is outwardly curved between a forward end of the insert 70 and a rearward end of the insert 70. When viewed in cross-section, the clamp elements 61, 62 each have a concave shaped inner surface 68. That is, the inner surface 68 of the clamp 60 is inwardly curved between a forward end (or a first point near the forward end) of the clamp 60 and a point offset rearwardly from the forward end of the clamp 60. In the example shown in FIG. 3, the inner surface 68 of the clamp extends for a distance rearwardly of the concavely shaped section. The cross-section referred to here is a cross-sectional plane which includes the central (longitudinal, forward-to-rear) axis 54 of the clamp 50. That is, the longitudinal axis 54 lies in the cross-sectional plane. The cut-away section of the clamp 60 and insert 70 shown in FIG. 3 is an example of a cross-sectional plane which includes the longitudinal axis 54 of the clamp 50. The concave shaped inner surface 68 of the clamp 60 is complementary to the convex shaped outer surface 78 of the insert 70. For example, the convex surface and the concave surface have the same radius of curvature. This allows the insert 70 to move with respect to the clamp 60, by sliding across the concave surface 68. The outer surface 78 of the insert 70 and the concave shaped inner surface 68 of the clamp 60 can be considered as a narrow section of a ball and socket type connector.

The insert 70 can be secured in a desired position with respect to the clamp 60. In this example, this is achieved by a combination of inward radial pressure applied by the clamp 60 around the insert 70 and by additional inward radial pressure provided by one or more fastenings 74 which act on the outer surface of the insert 70. A recess 73 is formed on the outer surface of the insert 70 at two diametrically opposite positions. These are positions adjacent to where adjustment fastenings 74 are located. The clamp elements 61, 62 each have a radial bore 65 to receive one of the fastenings 74. The radial bore 65 and the fastening 74 are threaded. The recesses 73 provide a region in which the insert 70 can be moved with respect to the fastenings 74. Each recess 73 has a radial wall 76 at a forward side and at a rearward side of the recess 73. The radial wall 76 functions as an end stop to limit movement of the insert 70 when it is rotated forward and backward about the x-axis. Although it is not visible in the cross-section, a radial wall 76 can also be provided on left and right sides of the recess, i.e. at positions which are circumferentially offset from the fastening 74 around the insert. Alternatively, the recess 73 can extend further around the insert 70. For example, the recess could be a continuous annular groove around the outer surface of the insert.

When a fastening 74 is fitted to the clamp element 61, a distal end of the fastening 74 locates within the recess 73 of the insert. The insert 70 can move with respect to the clamp until the fastening 74 presses against the radial wall 76. This prevents further movement of the insert 70. In this example, the radial walls 76 and the convex outer surface 78 of the insert are symmetrical about a centre line half-way along the depth of the insert 70. Other configurations are possible. A distal (inner) end of the fastening 74 applies a force which is directed radially-inwardly on the insert 70.

Figure 4:
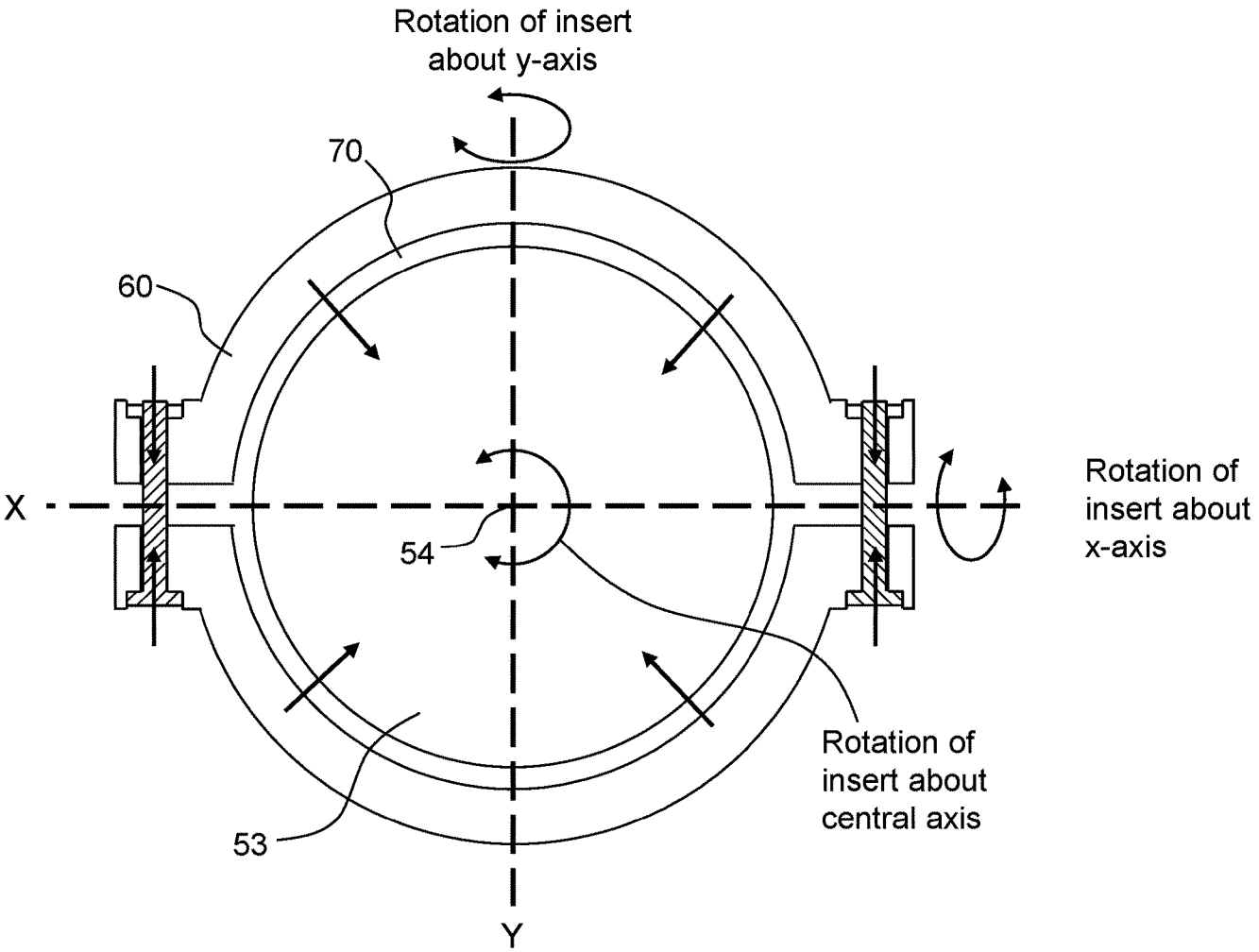
FIG. 4 shows possible adjustments of the mount.

FIG. 3 and FIG. 4 illustrate a range of possible relative movements of the insert 70 with respect to the clamp 60. The clamp 60 has a longitudinal or z-axis 54. The clamp can also be considered to have an x-axis X and a y-axis Y which are mutually perpendicular to the longitudinal axis (z-axis) 54. The complementary concave and convex surfaces 68, 78 may allow the insert to move: (i) about the x-axis X; (ii) about the y-axis Y; (iii) a combination of about the x-axis X and the y-axis Y.

In addition, rotation about the longitudinal axis 54 may be possible by rotating the night vision device 30 with respect to the insert 70. The amount of movement may be constrained by the tightness of the clamp 60 and fastenings 74. Rotation about the longitudinal axis 54 may be possible by rotating the insert 70 with respect to the clamp 60. The amount of rotational movement may be constrained by the shape of the recess 73. For example, the radial wall 76 of the recess 73 may only extend for a circumferential distance sufficient to accommodate the fastening 74.

Figure 5B:
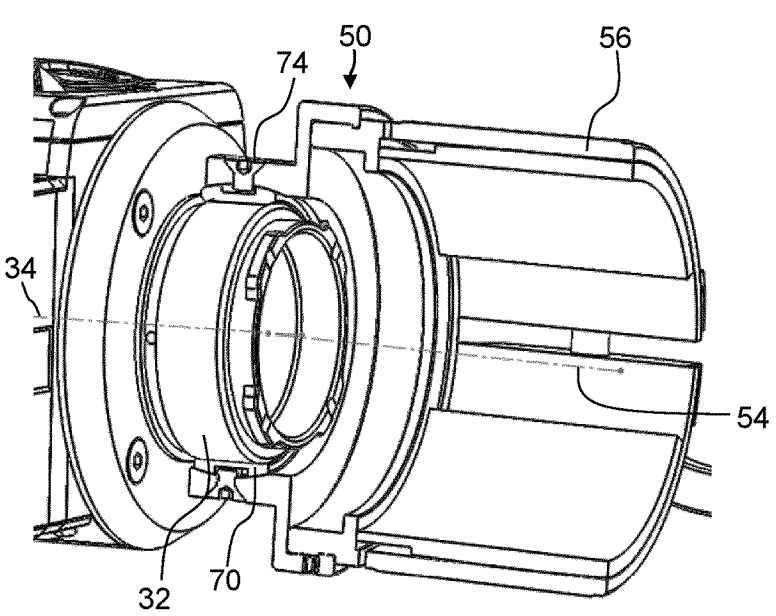
FIGS. 5A-5C show a night vision device connected to a mount in three different adjustment positions.
Figure 5A:
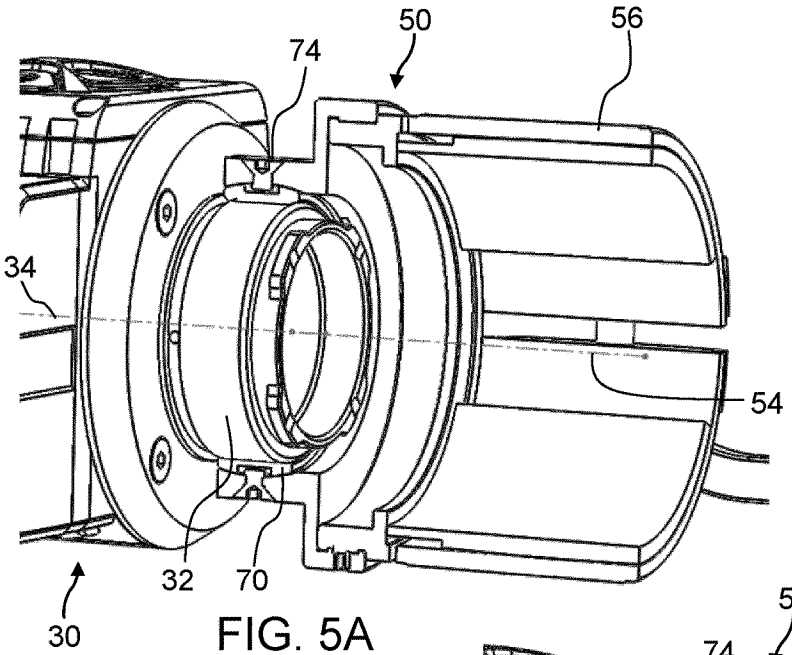
Figure 5C:
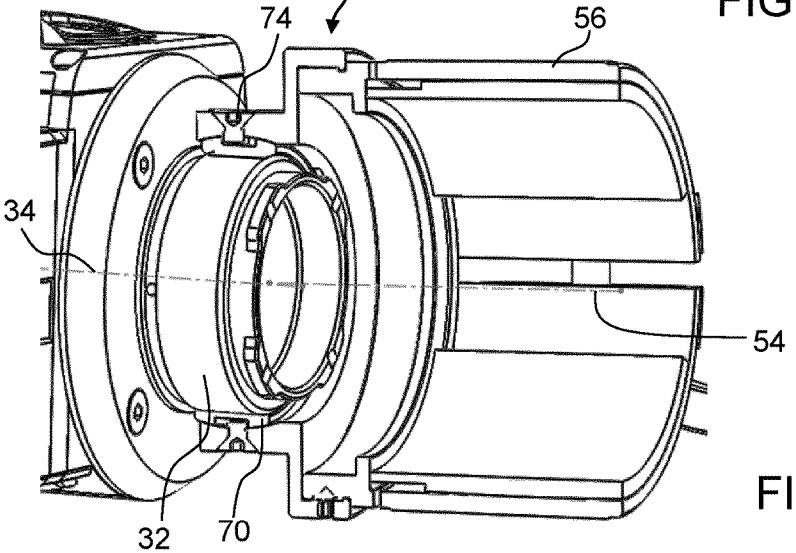

FIGS. 5A-5C shows a mount 50 connected to a night vision device 30 at three different relative positions. The night vision device 30 has an end portion (neck) 32 held within the mount 50. In FIG. 5A a longitudinal axis 34 of the night vision device 30 is aligned with the longitudinal axis 54 of the mount 50. The fastening 74 is centrally located within the recess of the insert 70. In FIG. 5B the longitudinal axis 34 of the night vision device 30 is offset from the longitudinal axis 54 of the day sight in a first angular direction about the x-axis. The fastening 74 is located against one of the end stops of the recess of the insert 70. In FIG. 5C the longitudinal axis 34 of the night vision device 30 is offset from the longitudinal axis 54 of the day sight in a second angular direction about the x-axis, opposite to the direction shown in FIG. 5B. The fastening 74 is located against the opposite end stop of the recess of the insert 70. FIGS. 5A-5C show the unobstructed line of sight between an optical window at an end face of the night vision device and the rearward end 52 of the mount.

An example of fitting the night vision device 30 to the mount 50 will now be described. In this example, the insert 70 is provided as part of the mount 50. Initially, the first C-shaped element 61 and the second C-shaped element 62 of the clamp 60 are loosely coupled together so that opening 53 is large enough to allow the neck of the night vision device 30 to be pushed into the opening. Then, the fastenings 66 are tightened (but not fully tightened) to cause the first C-shaped element 61 and the second C-shaped element 62 of the clamp 60 to close around the insert 70. This causes the clamp 60 and the insert 70 to loosely grip the neck of the night vision device 30. At this stage, the night vision device 30 can move relative to the insert 70. This can allow the user to rotate the night vision device 30 until a rectangular image from the display of the night vision device 30 is horizontally aligned within the field of view of the day sight 20. At this stage, the insert 70 can move relative to the clamp 60. This allows the user to adjust the position of the The degree of adjustment may be limited by the end stops (76, FIG. 3 and FIGS. 5B, 5C). When the night vision device 30 has been adjusted to a desired position/orientation, the clamp is fully tightened by tightening fastenings 66. The insert 70, and therefore the night vision device 30 within the insert 70, are now securely held in the desired position.

It will be understood that the mount also allows movement of the night vision device 30 relative to the mount 50 about a y-axis, or a combination of x-axis and y-axis.

It is also possible to rotate the night vision device 30 about the longitudinal axis 34 of the night vision device 30. One possible way of performing rotational adjustment of the night vision device is by rotating the night vision device 30 within the insert 70, before the fastenings 74 and the clamp 60 are fully tightened. When the insert 70 has an annular grove on an outer surface of the insert, another possible way of performing rotational adjustment of the night vision device is by rotating the night vision device 30 and insert 70 within the clamp 60, before the fastenings 74 and the clamp 60 are fully tightened.

A neck of a night vision device 30 may have a diameter which differs between different manufacturers. Advantageously the opening of the clamp 50 has dimensions matched to a neck of a night vision device 30.

Figure 6B:
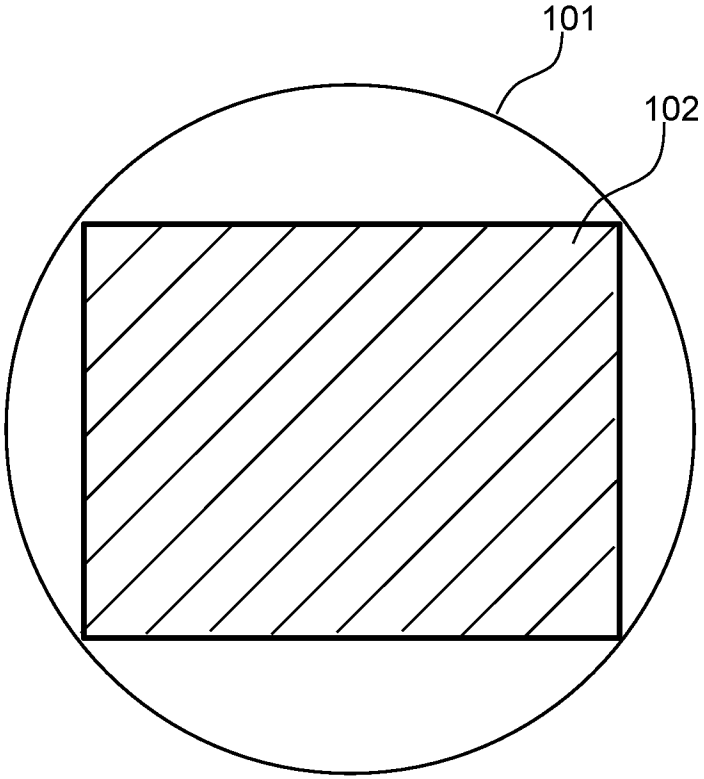
FIGS. 6A and 6B show a view through a day sight in two different adjustment positions.
Figure 6A:
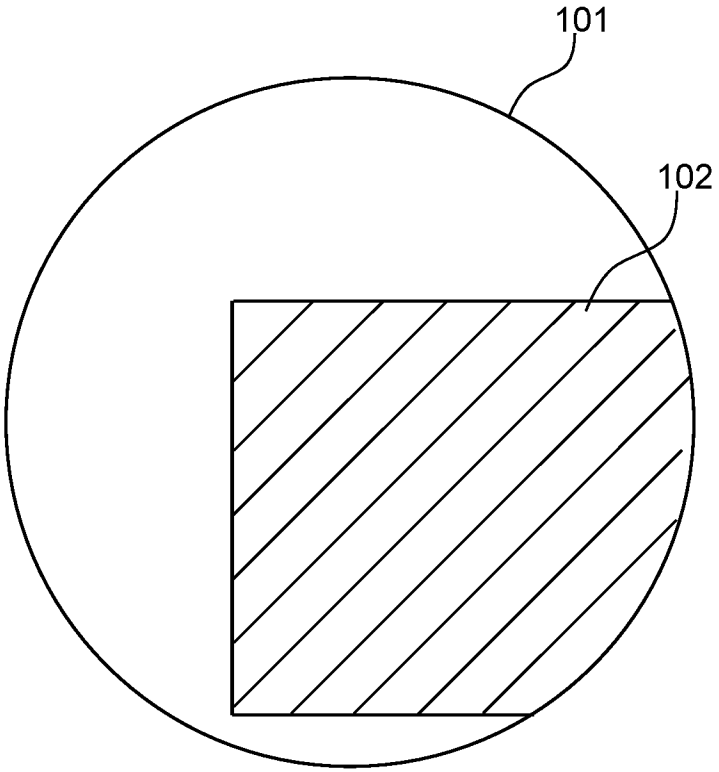

FIGS. 6A and 6B each show a view through the day sight 20 with the night vision device 30 fitted. In FIG. 6A, the night vision device 30 is not aligned with the day sight 20. An image 102 output by the night vision device 30 is offset from a centre of the field of view 101 of the day sight. This results in only part of the night vision device being visible. In FIG. 6B, a position of the night vision device 30 has been adjusted so that it contributes an image 102 which is centrally positioned within the field of view 101 of the day sight 20.

Figure 7:
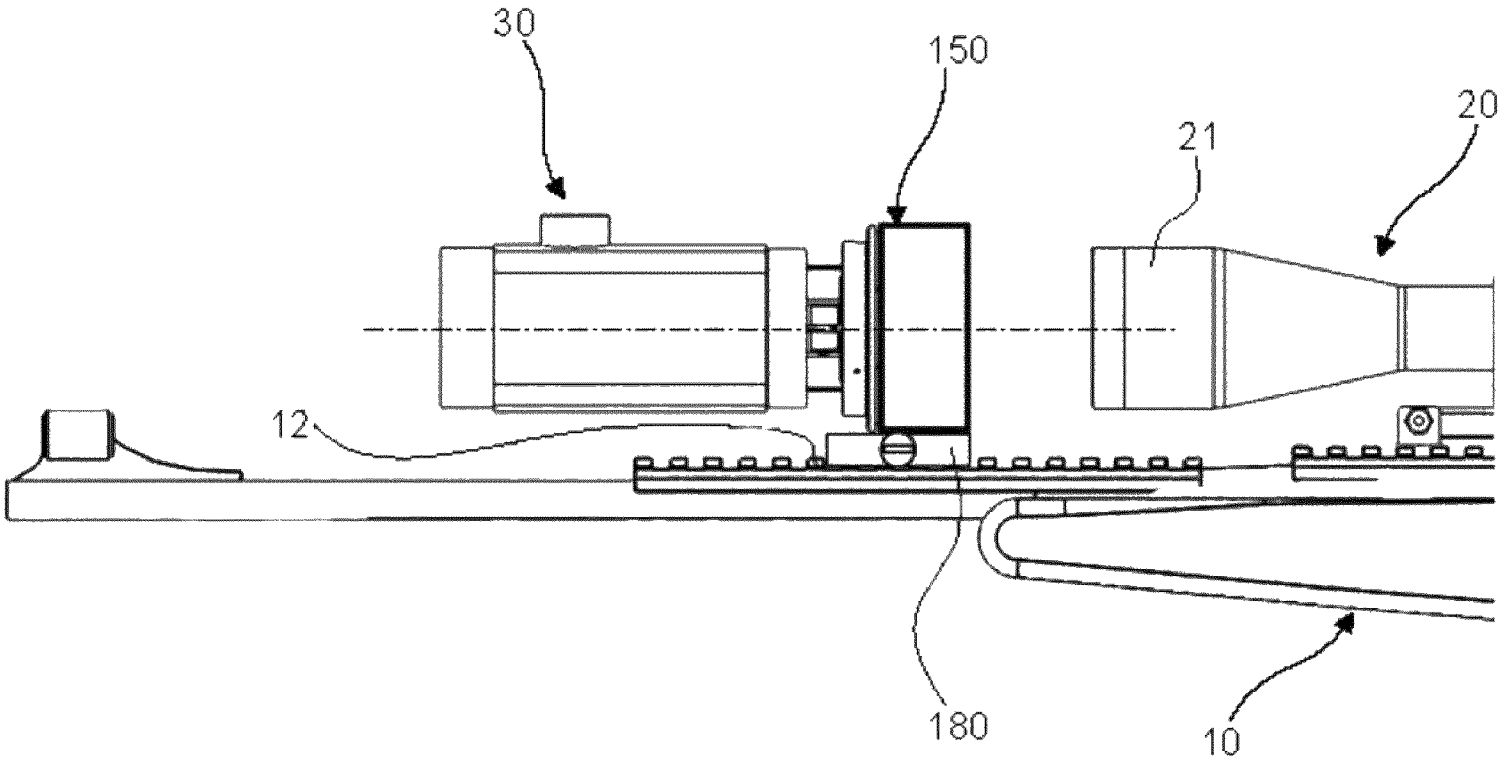
FIG. 7 shows an example rifle with a day sight and a night vision device mounted to the rifle in front of the day sight.

FIG. 7 shows another example of a rifle 10 with a day sight 20 and a night vision device 30. The day sight 20 is mounted to a top surface of the rifle 10, as in FIG. 1. The day sight 20 has a forward end 21. The night vision device 30 is fitted to the rifle 10 via a mount 150. The mount 150 aligns the night vision device 30 with the day sight 20. In contrast to FIG. 1, the mount 150 connects to the body of the rifle 10. The mount 150 connects to the body of the rifle 10 at a position in front of a forward end 21 of the day sight 20. The mount 150 has many features in common with the mount previously described. A main difference is that the mount 150 does not require the second fitting at the rearward end for connecting to the day sight 20. Instead, the mount 150 has a fitting 180 which allows it to connect to the body of the rifle 10. The rifle 10 may have one or more rails mounted along a top surface 12 of the body of the rifle.

The mount 150 has a clamp 60 and insert 70 as described above with reference to FIGS. 2-4. Adjustment of the position of the night vision device is similar to FIGS. 5A-5C, except that there is not a day sight connected to the rearward end of the mount.

Alternative Forms of Insert

In the example shown in FIG. 2 and FIG. 3, the insert 70 is secured by a combination of pressure applied by the clamp 60 and by fastenings 74. In other examples, it is possible to omit the fastenings 74 and recesses 73 or groove around the insert, and to just use the clamp 60 to secure the insert with respect to the clamp.

Figure 8:
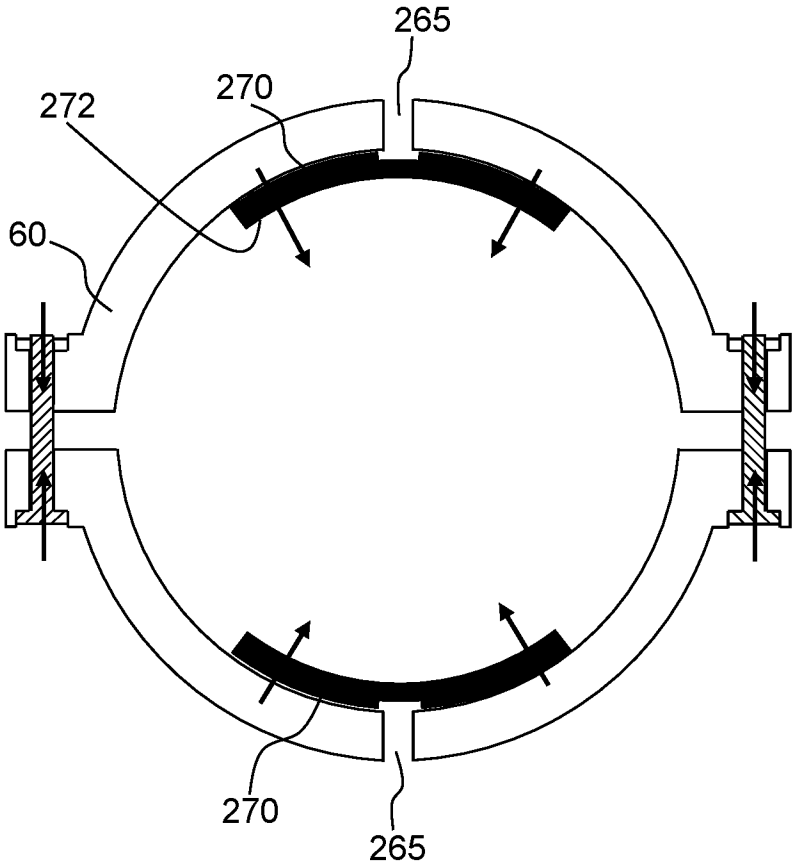
FIG. 8 shows an alternative form of the insert for the mount.

The insert 70 shown above is a generally cylindrical-shaped element with a continuous inner surface 72. FIG. 8 shows another insert 270. The insert 270 fits within an opening defined by a clamp 60. Insert 270 comprises a plurality of segments. The example shown in FIG. 8 has two segments which are positioned diametrically opposite one another. In other examples, the total number of segments may be 3, 4, or a larger number. The segments 270 can be considered as portions or fragments of the insert 70 and operate in the same manner as insert 70. Segments 270 fit within the clamp 60. Each segment 270 has an inner surface 272 which is arc-shaped when viewed in cross-section (as in FIG. 8), and extending parallel to a longitudinal axis of the opening. Each segment 270 has a convex outer surface. Each segment 270 has a recess at a position adjacent to a bore 265 in the clamp 60, each of the segments 270 can extend for a longer, or shorter, circumferential distance than shown in FIG. 8.

Alternative Forms of Clamp

Figure 9:
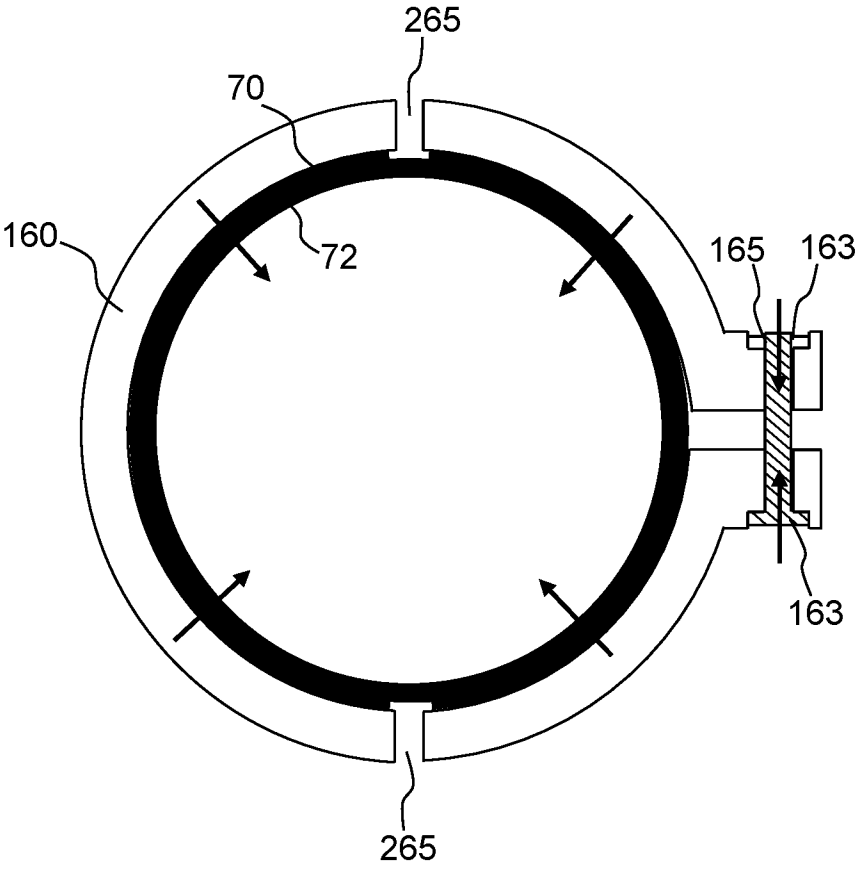
FIG. 9 shows an alternative form of the clamp for the mount.

The clamp 60 shown above a pair of generally C-shaped, or semi-circular shaped, elements 61, 62. The clamp may have a different form. FIG. 9 shows a cross-section of an alternative form of clamp 160. Clamp 160 is similar to the second fitting described above. Clamp 160 comprises a generally hoop-shaped element which defines an opening for receiving an end of the night vision device 30. The hoop-shaped element has a pair of radially extending portions (ears) 163. There is a radially extending portion 163 at each end of the hoop-shaped element. The radially extending portions 163 each have a bore 165. The bores 165 in adjacent radially extending portions 163 axially align with one another. A fastening is fitted to the bores 165 in the adjacent radially extending portions 163. The fastening is a bolt, a screw or any other suitable fastening. In use, the fastening can be tightened to cause the radially extending portions of the clamp to move towards one another, thereby tightening the hoop-shaped element around the insert 70 and the night vision device inside the insert 70. The hoop-shaped element has a concave inner surface similar to the one described above for clamp 60. This allows an adjustment of a position the insert 70 to move relative to the hoop-shaped element. The insert 70 in this example could be replaced by the multi-segment insert 270 shown in FIG. 8, or some other form of insert.

Figure 10:
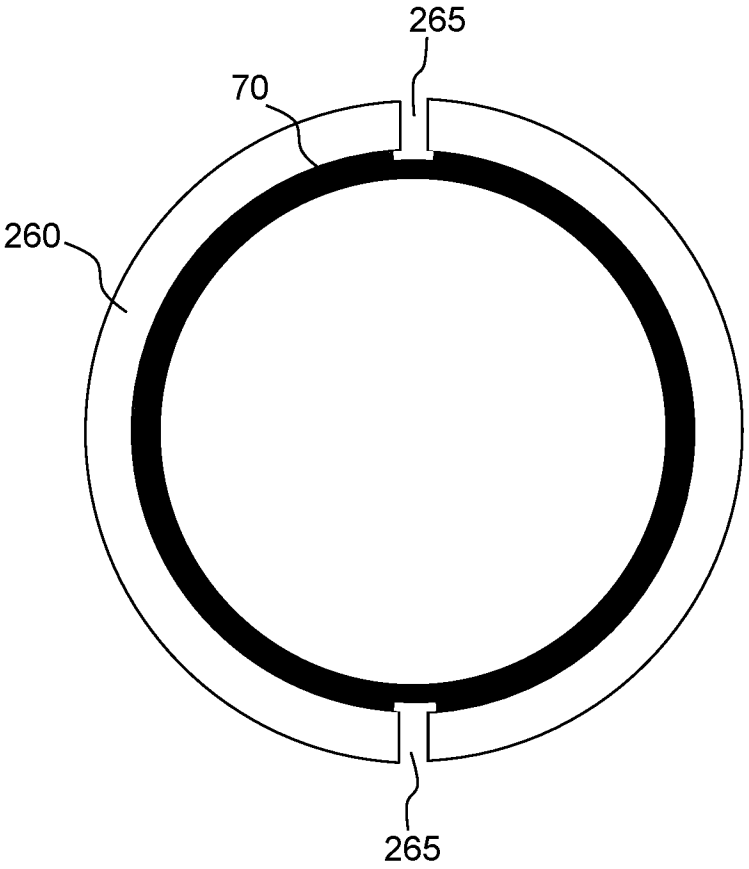
FIG. 10 shows an alternative form of the clamp for the mount.

FIG. 10 shows a cross-section of another alternative form of clamp 260. In the clamps 60, 160 shown FIG. 3 and FIG. 9 the clamp has one, or a pair of, elements which can be tightened around the insert held within the clamp. Clamp 260 operates in a different way. Clamp 260 comprises a cylindrical element. The cylindrical element has an inner diameter, when viewed in cross-section, which is substantially the same as an outer diameter of the insert 70. The cylindrical element has a concave inner surface when viewed in cross-section, similar to the one described above for clamp 60. This allows an adjustment of a position the insert 70 to move relative to the cylindrical element. Clamp 260 has a plurality of radial bores 265. The radial bores are the same, or similar, to the bores 65 described above for FIG. 3. Each of the bores 265 receives a fastening. A distal (inner) end of the fastening applies a force which is directed radially-inwardly on the insert 70. In this example, it is the fastenings in bores 265 which lock the relative positions of the clamp 260 and the insert 70.

Alternative Forms of Mount

Figure 11:
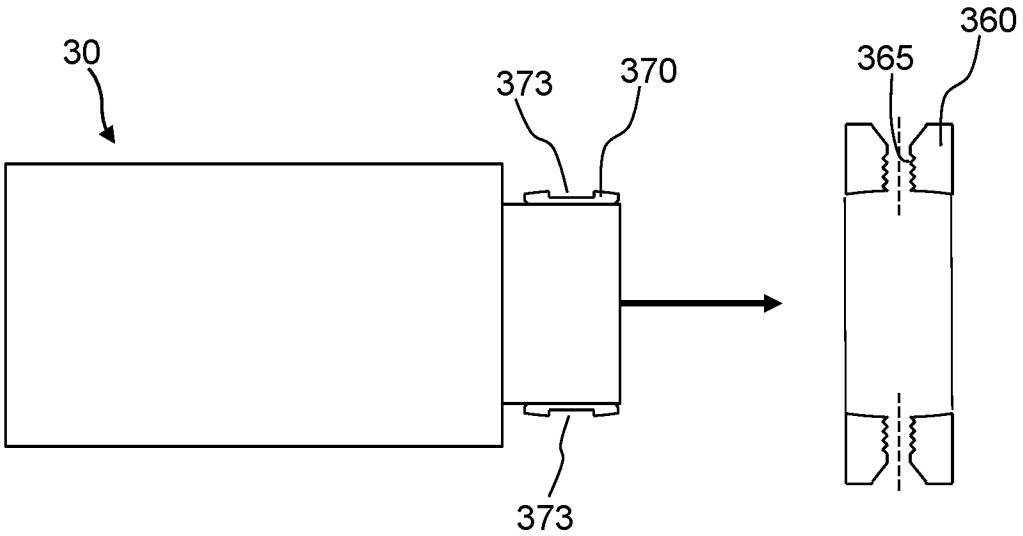
FIG. 11 shows an insert provided on a night vision device.

FIG. 11 shows an example of an arrangement where a night vision device 30 is provided with an insert 370 as part of the end portion (neck) of the night vision device 30. The insert 370 may be integrated with the end portion of the night vision device 30. That is, the insert 370 is an integral part of the night vision device, and is not separable from it. In use, the clamp 360 of the mount is opened. For an example where the clamp 360 is formed by two C-shaped elements (as in FIGS. 2, 3), the C-shaped elements are separated. The neck of the night vision device 30, with the integrated insert 370, is placed within the clamp 360 of the mount and then the clamp 360 is closed around the neck of the night vision device 30. The remainder of the adjustment operation is the same as described above. The insert 370 can have a continuous groove 373 around the outer surface of the insert and the clamp 360 can have threaded bores 365 to receive fastenings. The fastenings locate within the groove 373 and limit movement of the insert 370 with respect to the clamp 360. In an alternative arrangement, the groove 373 and the threaded bores 365 can be omitted and the clamp 360 can secure the insert 370 by pressure applied via the complementary concave surface of the clamp 360 and the convex surface of the insert 370. Other features of the insert and clamp are the same as described above.

Figure 12:
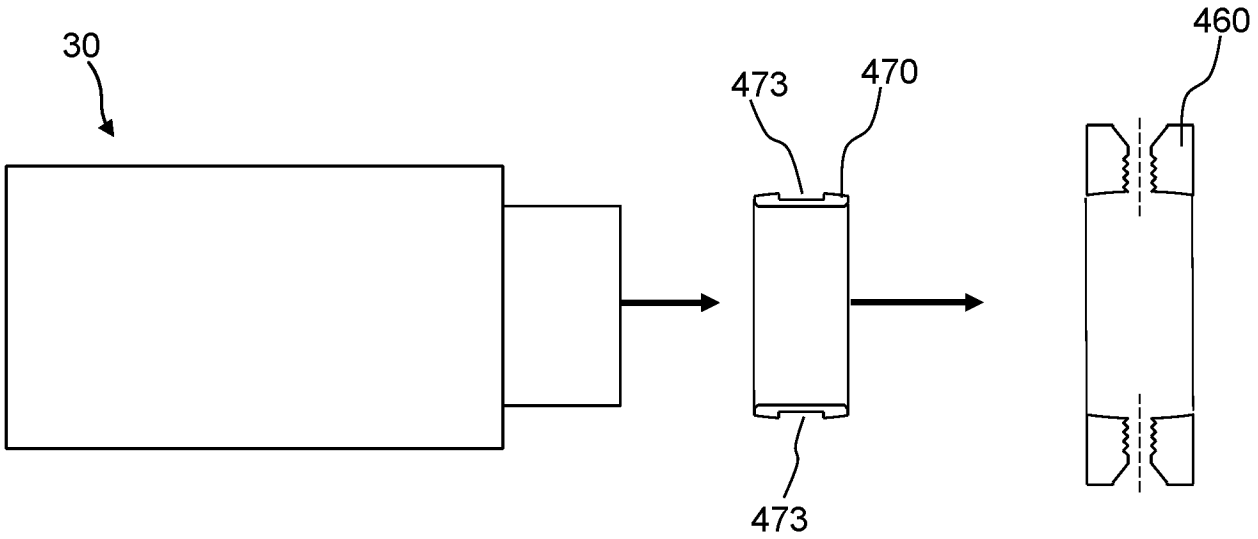
FIG. 12 shows an insert provided separately to a night vision device and a clamp.

FIG. 12 shows an example of an arrangement where an insert 470 is provided separately from a night vision device 30 and a clamp 460. The insert 470 is fitted around the neck of the night vision device 30 and then the insert 470 and night vision device 30 are placed within the clamp 460. The clamp 360 is closed around the insert 470 and the neck of the night vision device 30. The remainder of the adjustment operation is the same as described above. The insert 470 can have a continuous groove 473 around the outer surface of the insert and the clamp 460 can have threaded bores 365 to receive fastenings. The fastenings locate within the groove 473 and limit movement of the insert 470 with respect to the clamp 460. In an alternative arrangement, the groove 473 and the threaded bores 465 can be omitted and the clamp 460 can secure the insert 470 by pressure applied via the complementary concave surface of the clamp 460 and the convex surface of the insert 470. Other features of the insert and clamp are the same as described above.

The insert can be made from a range of possible materials. The insert may be made from a polymer material, metal or any other suitable material. The insert may be a rigid material.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A mounting apparatus for supporting a night vision device, the mounting apparatus comprising:

a clamp having an opening for receiving an end portion of the night vision device, the clamp having a concave inner surface when viewed in cross-section and a longitudinal axis;

an insert configured to locate within the opening of the clamp, the insert having an inner surface for locating against the night vision device, or the insert being integrated with the night vision device, the insert having a convex outer surface when viewed in cross-section, wherein the convex outer surface of the insert is movable across the concave inner surface of the clamp to allow adjustment of a position of the insert relative to the clamp about an x axis and/or a y axis which are mutually perpendicular to the longitudinal axis; and wherein the clamp is configured to secure the insert in a selected position.

2. A mounting apparatus according to claim 1 wherein the clamp has a radial bore for receiving a fastening to secure the insert in a selected position.

3. A mounting apparatus according to claim 2 wherein the insert has a recess for receiving a distal end of the fastening.

4. A mounting apparatus according to claim 3 wherein the recess is defined by radial walls of the insert, and wherein the recess has a dimension which is greater than a width of the distal end of the fastening to allow adjustment of adjustment of a position of the insert relative to the clamp.

5. A mounting apparatus according to claim 3 wherein the recess extends around the outer surface of the insert to permit rotational adjustment of a position of the insert relative to the clamp.

6. A mounting apparatus according to claim 2 wherein there is a plurality of fastenings spaced around the clamp.

7. A mounting apparatus according to claim 2 wherein there is a pair of fastenings at diametrically opposite positions on the clamp.

8. A mounting apparatus according to claim 1 wherein the insert comprises a circular element with a continuous inner surface.

9. A mounting apparatus according to claim 1 wherein the insert comprises a plurality of arcuate segments which are spaced apart around a perimeter of the opening.

10. A mounting apparatus according to claim 1 wherein the clamp is configured to apply a radially inwardly directed retaining force on the insert, wherein the retaining force is applied via the inner surface of the clamp.

11. A mounting apparatus according to claim 1 wherein the clamp comprises a first C-shaped element and a second C-shaped element which together define the opening, and a fastening mechanism which is configured to tighten the first C-shaped element and the second C-shaped element together.

12. A mounting apparatus according to claim 11 wherein each of the first C-shaped element and the second C-shaped element has a radially extending portion at each end, wherein the fastening mechanism is configured to apply a retaining force between a respective radially extending portion of the first C-shaped element and the second C-shaped element.

13. A mounting apparatus according to claim 12 wherein each of the radially extending portions has a bore for receiving a fastening.

14. A mounting apparatus according to claim 1, wherein the clamp is provided at a forward end of the mounting apparatus, the mounting apparatus having a rearward end and a through passage between the forward end and the rearward end, the through passage including the opening.

15. A mounting apparatus according to claim 1 wherein the mounting apparatus is configured to one of: connect to a body of a rifle; connect to a day sight.

16. A mounting apparatus according to claim 1 wherein the clamp is provided at a forward end of the mounting apparatus, the mounting apparatus having a fitting at a rearward end for fitting to a day sight.

17. A mounting apparatus according to claim 16 wherein the fitting comprises a clamp which defines an opening for receiving an end portion of the day sight device.

18. A mounting apparatus according to claim 1 wherein the mounting apparatus is configured to connect to a body of a rifle, the mounting apparatus comprising a fitting for fitting to a housing of the rifle.

19. A mounting apparatus according to claim 1 wherein the insert is removable from the clamp.

20. A combination of:

a night vision device comprising an end portion; and a mounting apparatus according to claim 1.

21. A combination according to claim 20 wherein the insert is provided on the end portion of the night vision device.

22. A clamp for use in the mounting apparatus of claim 1, the clamp having an opening for receiving an end portion of the night vision device, the clamp having a concave inner surface and a longitudinal axis, wherein the clamp is configured to receive an insert having a convex outer surface, wherein the convex outer surface of the insert is movable across the concave inner surface of the clamp to allow adjustment of a position of the insert relative to the clamp about an x axis and/or a y axis which are mutually perpendicular to the longitudinal axis, wherein the clamp is configured to secure the insert in a selected position.

23. A method of supporting a night vision device, comprising:

receiving an end portion of the night vision device in an opening of a clamp having a concave inner surface when viewed in cross-section and a longitudinal axis;

providing an insert having an inner surface for locating against the night vision device, or the insert being integrated with the night vision device, whereby a convex outer surface of the insert when viewed in cross-section is movable across the concave inner surface of the clamp to allow adjustment of a position of the insert relative to the clamp about an x axis and/or a y axis which are mutually perpendicular to the longitudinal axis; and securing the insert in a selected position by means of the clamp.

* * * * *